United States Patent [19]

Lundquist

[11] 4,018,468

[45] Apr. 19, 1977

[54] LIFTING RING FOR PLASTIC DRUMS

[76] Inventor: Merlin L. Lundquist, 2626 Country Club Court, Stockton, Calif. 95204

[22] Filed: May 28, 1976

[21] Appl. No.: 690,996

[52] U.S. Cl. ..... 294/67 BA; 214/374; 214/620; 221/71; 294/31.2; 294/90

[51] Int. Cl.[2] ..... B66C 1/10

[58] Field of Search ..... 294/1 R, 4, 31.2, 67 R, 294/67 B, 67 BA, 67 D, 67 DA, 67 DB, 86 R, 90; 214/374, 620, 621, 650 R, 651, 653; 220/85 R, 85 H, 71, 73, 319; 224/45 A, 45 C, 45 P, 45 Q

[56] References Cited

UNITED STATES PATENTS

| | | | |
|---|---|---|---|
| 413,981 | 10/1889 | Taplin | 294/31.2 |
| 1,403,404 | 1/1922 | Grumpelt | 220/71 |
| 1,456,716 | 5/1923 | Resek | 294/31.2 |
| 2,670,095 | 2/1954 | Blatz | 214/653 |
| 2,826,330 | 3/1958 | Imparato | 220/71 |
| 2,831,720 | 4/1958 | Renfroe | 294/31.2 |
| 3,052,441 | 9/1962 | Fleischman | 214/374 X |
| 3,081,893 | 3/1963 | Holsclaw | 214/620 X |
| 3,310,336 | 3/1967 | Chenault | 294/90 |

*Primary Examiner*—Johnny D. Cherry
*Attorney, Agent, or Firm*—Roger B. Webster

[57] ABSTRACT

A ring is mounted, in horizontally surrounding relation, on a plastic drum adjacent but short of the upper end thereof; the ring being fixed on the drum, and structurally designed to provide an annular lip extending coaxially about the drum in radially outwardly spaced relation to the drum sidewall whereby the lip is exposed for engagement by the gripping device of a lift-type industrial truck employed to lift and transport such plastic drum.

3 Claims, 6 Drawing Figures

LIFTING RING FOR PLASTIC DRUMS

BACKGROUND OF THE INVENTION

Heretofore, certain products— such as chemicals, food products, etc.—have been commercialized in large (55 gallon) metallic drums having an integral bead at the upper end; the gripping device, of a lift-type industrial truck, engaging such bead preparatory to lifting and transporting each such drum. In the trade there is now occurring a transition from metal drums to plastic drums, and as a consequence a problem is presented in that plastic drums either do not have an upper end bead for gripping, or the bead cannot withstand, without damage, engagement of the gripping device. The present invention was conceived in a successful effort to solve such problem.

SUMMARY OF THE INVENTION

The present invention provides, as a major object, a lifting ring fixedly mounted, in horizontally surrounding relation, on a plastic drum adjacent but short of the upper end thereof; the ring being structurally designed to permit of ready and effective engagement thereof by the gripping device of a lift-type industrial truck employed to lift and transport such plastic drum.

The present invention provides, as another important object, a lifting ring for a plastic drum, as in the preceding paragraph, which comprises—in integral relation—an annular horizontally facing band tightly seated in a circumferential groove formed in the drum sidewall, an annular vertically facing flange projecting radially outwardly from the upper edge of the band to an outer edge termination a distance beyond the drum sidewall, and an annular lip extending coaxially about the drum and upstanding from the outer edge of said annular flange in radially outwardly spaced relation to the drum sidewall whereby said lip is exposed for engagement by the gripping device of the lift-type industrial truck employed to lift and transport the plastic drum.

The present invention provides, as a further object, a lifting ring for plastic drums which is designed for ease and economy of manufacture, and convenience of installation.

The present invention provides, as a still further object, a practical, reliable, and durable lifting ring for plastic drums, and one which is exceedingly effective for the purpose for which it is designed.

DESCRIPTION OF THE PREFERRED EMBODIMENT

Figure 1:
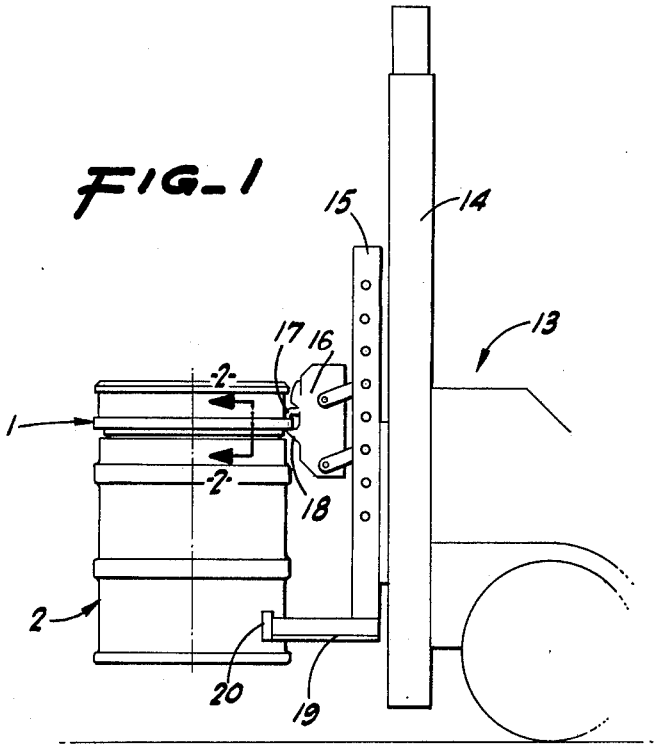
FIG. 1 is an elevation of a plastic drum fitted with the lifting ring; the drum being illustrated as engaged by a lift-type industrial truck shown in part and essentially in outline.
Figure 2:
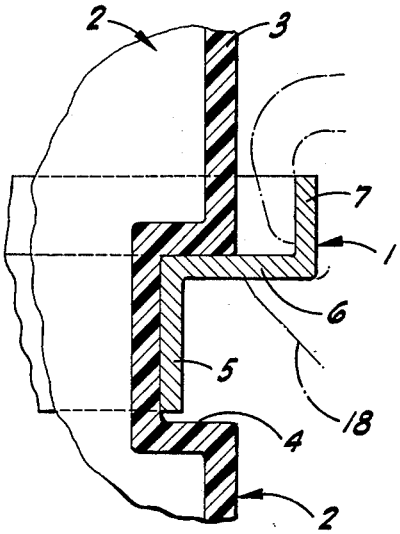
FIG. 2 is an enlarged, fragmentary, transverse section taken substantially on line 2—2 of FIG. 1.
Figure 3:
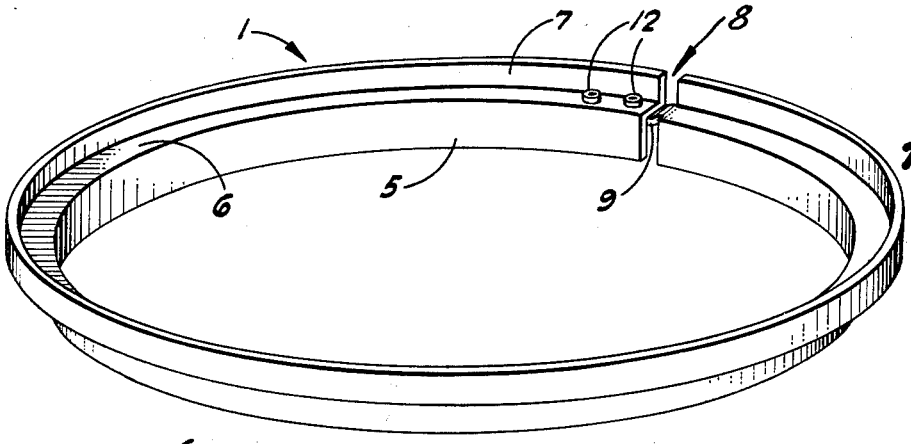
FIG. 3 is an enlarged perspective view of the lifting ring, detached.
Figure 4:
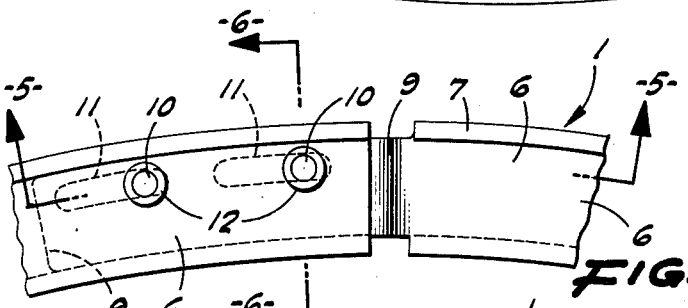
FIG. 4 is an enlarged, fragmentary plan view illustrating the manner of connecting the ends of the lifting ring; the latter being split at a point in its circumference.
Figure 6:
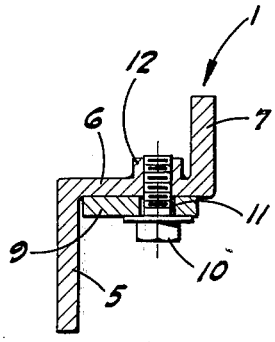
FIG. 6 is a fragmentary, transverse section taken substantially on line 6—6 of FIG. 4.
Figure 5:
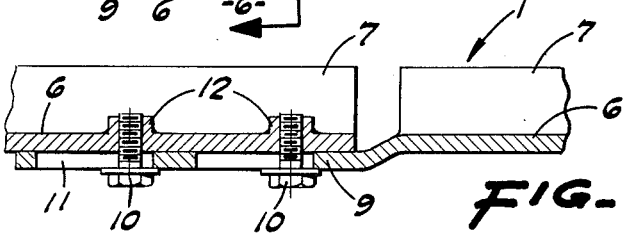
FIG. 5 is a fragmentary, sectional elevation taken substantially on line 5—5 of FIG. 4.

Referring now more particularly to the drawings and to the characters of reference marked thereon, the lifting ring—of metal or high-strength plastic, and indicated generally at 1—is mounted in tight, surrounding relation on the upper portion of a plastic drum, indicated generally at 2.

The drum sidewall 3 is formed adjacent but short of the upper end of the drum, with a circumferential groove 4 which is substantially rectangular in cross section. The lifting ring 1 is structurally shaped to seat in, and project outwardly from, the groove 4 as now more particularly described.

The lifting ring 1 comprises, in integral relation, an annular, horizontally facing band 5 tightly seated in the bottom of groove 4; an annular, vertically facing flange 6 projects radially outwardly from the upper edge of the band to an outer edge termination a distance beyond the drum sidewall; and an annular lip 7 extends coaxially about the drum and upstands from the outer edge of annular flange 6 in radially outwardly spaced relation to the drum sidewall 3.

With the ring constructed and mounted, as above, the lip 7 is exposed exteriorly of the drum for engagement, as will hereinafter appear, by a drum-handling vehicle.

At one point in its circumference, the ring 1 is radially split, as at 8; this being to permit the ring to be sprung open or expanded sufficient to encompass the drum 2 for passage thereover, and thence contracted into the groove 4. Thereafter, the ring 1 is tightened, and then locked in the groove 4 by means of a tongue 9 which extends from one split end of flange 6 and underlies, in matching relation, the near portion of said flange on the opposite side of the split 8. The tongue 9 is fixedly secured to such near portion of the flange 6 by locking bolts 10 which pass through elongated adjustment slots 11 in said tongue, and thence thread into fixed-in-place nuts 12 on said near portion of the flange 6.

Thus, after the ring 1 is initially disposed in the groove 4, the ring is tightened in such groove and locked up by the bolts 10; the latter being accessible, for wrench engagement, outwardly of the groove 4.

A plastic drum 2, fitted with a lifting ring 1, as above described, can be readily, and without damage to such plastic drum, lifted and transported by a lift-type industrial truck as shown in part and in outline generally at 13. A truck of such type—as shown, for example, in U.S. Pat. No. 2,698,107—includes an upstanding main frame 14 which supports a vertically adjustable elevator frame 15 fitted, at the front, with a power-actuated gripping device 16 having an upper jaw 17 and a cooperating lower jaw 18. This jaw assembly is sometimes known as a "parrot's beak". Some distance below the gripping device 16, the elevator frame 15 carries a forwardly projecting arm 19 fitted on the outer end with a horizontal cradle 20.

To lift and transport the drum 12, the elevator frame 15 and gripping device 16 are adjusted to the correct height, and then the upstanding lip 7 is embraced by and clamped between the jaws 17 and 18; the lower portion of the drum then being engaged in the cradle 20. Thereafter, the elevator frame 15 is adjusted upward until the drum clears to ground, and thence the drum is transported by truck 13 from place to place.

From the foregoing description, it will be readily seen that there has been produced such a lifting ring for plastic drums as substantially fulfills the objects of the invention as set forth herein.

While this specification sets forth in detail the present and preferred construction of the lifting ring for plastic drums, still in practice such deviations from such detail may be resorted to as do not form a departure from the spirit of the invention as defined by the appended claims.

I claim:

1. In the combination of an upright drum, and a lifting ring surrounding, and secured to, the sidewall of the drum; the improvement characterized by the drum sidewall having a horizontal circumferential groove formed therein in spaced relation below the upper end of said drum, and the lifting ring being tightly seated in the groove; said lifting ring including an integral, annular, vertically facing flange projecting radially outwardly from the groove to an outer edge termination a distance beyond the drum sidewall, and an annular lip formed integrally with and upstanding from the outer edge of said annular flange and spaced substantially said distance from the drum sidewall whereby the upstanding lip is exposed exteriorly of the drum or ready, unobstructed access from above and gripping engagement by a gripping device of a drum lifting and transporting vehicle.

2. An improvement, as in claim 1, in which the groove is substantially rectangular in cross section providing in the groove a flat bottom and a flat upper face, and the band and the flange being flat and matchingly engaging said bottom and face, respectively.

3. In the combination of an upright drum, and a lifting ring surrounding, and secured to, the sidewall of the drum; the improvement characterized by the drum sidewall having a horizontal, circumferential groove formed therein in spaced relation below the upper end of said drum, and the lifting ring including an annular, horizontally facing band tightly flush-seated in the groove against the bottom thereof, an annular vertically facing flange formed integrally with the upper edge of the band and projecting radially outwardly therefrom to an outer edge termination a distance beyond the drum sidewall, and an annular lip formed integrally with and upstanding from the outer edge of said annular flange and spaced substantially said distance from the drum sidewall whereby the upstanding lip is exposed exteriorly of the drum for ready, unobstructed access from above and gripping engagement by a gripping device of a drum lifting and transporting vehicle.

* * * * *